US010648050B2

(12) United States Patent
Katsumata

(10) Patent No.: US 10,648,050 B2
(45) **Date of Patent: *May 12, 2020**

(54) HEAT TREATMENT APPARATUS

(71) Applicants: IHI Corporation, Tokyo (JP); IHI Machinery and Furnace Co., Ltd., Tokyo (JP)

(72) Inventor: Kazuhiko Katsumata, Inuyama (JP)

(73) Assignees: IHI CORPORATION, Tokyo (JP); IHI MACHINERY AND FURNACE CO., LTD., Tokyo (JP)

( * ) Notice: Subject to any disclaimer, the term of this patent is extended or adjusted under 35 U.S.C. 154(b) by 349 days.

This patent is subject to a terminal disclaimer.

(21) Appl. No.: 15/716,837

(22) Filed: Sep. 27, 2017

(65) Prior Publication Data

US 2018/0016652 A1 Jan. 18, 2018

Related U.S. Application Data

(63) Continuation of application No. PCT/JP2016/005712, filed on Mar. 7, 2016.

(30) Foreign Application Priority Data

May 26, 2015 (JP) ..... 2015-106336

(51) Int. Cl.

| | |
|---|---|
| ***F27D 7/06*** | (2006.01) |
| ***C21D 1/773*** | (2006.01) |
| ***F27B 17/00*** | (2006.01) |
| ***C21D 11/00*** | (2006.01) |
| ***C21D 1/767*** | (2006.01) |
| ***F27D 15/02*** | (2006.01) |
| ***C21D 1/62*** | (2006.01) |

(Continued)

(52) U.S. Cl.

CPC ..... *C21D 1/773* (2013.01); *C21D 1/62* (2013.01); *C21D 1/767* (2013.01); *C21D 11/005* (2013.01); *F27B 17/00* (2013.01); *F27B 17/0016* (2013.01); *F27D 7/06* (2013.01); *F27D 15/02* (2013.01); *C21D 1/00* (2013.01); *F27B 2017/0091* (2013.01); *F27D 2009/0005* (2013.01); *F27D 2009/0072* (2013.01)

(58) Field of Classification Search

CPC ..... C21D 1/773; F27D 7/06

See application file for complete search history.

(56) References Cited

U.S. PATENT DOCUMENTS 5,052,923 A 10/1991 Peter et al.
5,273,585 A 12/1993 Shoga et al.

(Continued)

FOREIGN PATENT DOCUMENTS

CN 1813163 A 8/2006
CN 101970696 A 2/2011

(Continued)

*Primary Examiner* — Scott R Kastler

(74) *Attorney, Agent, or Firm* — Rothwell, Figgs, Ernst & Manbeck, P.C.

(57) ABSTRACT

This heat treatment apparatus is configured such that a treating target is conveyed via an intermediate conveyance chamber and accommodated in a heating chamber. The heat treatment apparatus is provided with a gas cooling chamber that is disposed adjacent to the intermediate conveyance chamber and in which the treating target is cooled using a cooling gas containing an oxidizer.

12 Claims, 5 Drawing Sheets

(51) Int. Cl.

| | |
|---|---|
| *C21D 1/00* | (2006.01) |
| *F27D 9/00* | (2006.01) |

(56) References Cited

U.S. PATENT DOCUMENTS

| | | | | |
|---|---|---|---|---|
| 5,871,806 | A | 2/1999 | Shoga et al. | |
| 6,913,449 | B2 | 7/2005 | Loeser et al. | |
| 7,625,204 | B2 | 12/2009 | Katsumata | |
| 8,152,935 | B2 | 4/2012 | Katsumata | |
| 8,734,147 | B2 | 5/2014 | Katsumata | |
| 2002/0031740 | A1 | 3/2002 | Gam et al. | |
| 2003/0113186 | A1 | 6/2003 | Hiramoto | |
| 2003/0145907 | A1 | 8/2003 | Edenhofer | |
| 2006/0118209 | A1 | 6/2006 | Edenhofer | |
| 2006/0119021 | A1 | 6/2006 | Edenhofer | |
| 2007/0122761 | A1 | 5/2007 | Katsumata | |
| 2007/0212657 | A1 | 9/2007 | Katsumata et al. | |
| 2008/0073001 | A1 | 3/2008 | Katsumata | |
| 2008/0247901 | A1 | 10/2008 | Morita et al. | |
| 2009/0186311 | A1 | 7/2009 | Katsumata | |
| 2011/0262877 | A1 | 10/2011 | Katsumata | |
| 2012/0133089 | A1* | 5/2012 | Kobayashi | C21D 1/40 266/155 |
| 2013/0019796 | A1 | 1/2013 | Yamada et al. | |
| 2013/0153547 | A1 | 6/2013 | Katsumata | |
| 2014/0131930 | A1 | 5/2014 | Katsumata | |
| 2015/0381014 | A1 | 12/2015 | Lee | |
| 2017/0307296 | A1* | 10/2017 | Katsumata | C21D 1/00 |
| 2018/0016652 | A1* | 1/2018 | Katsumata | C21D 1/767 |

FOREIGN PATENT DOCUMENTS

| | | | |
|---|---|---|---|
| CN | 102089610 | A | 6/2011 |
| DE | 195 01 873 | C2 | 7/1997 |
| DE | 297 17 714 | U1 | 11/1997 |
| EP | 0 995 960 | B1 | 1/2005 |
| EP | 1 333 105 | B1 | 4/2008 |
| JP | 56-9325 | A | 1/1981 |
| JP | 2-20099 | U | 2/1990 |
| JP | 5-5171 | A | 1/1993 |
| JP | 8-178535 | A | 7/1996 |
| JP | 8-295926 | A | 11/1996 |
| JP | 11-153386 | A | 6/1999 |
| JP | 2003-183728 | A | 7/2003 |
| JP | 2003-183807 | A | 7/2003 |
| JP | 2004-84997 | A | 3/2004 |
| JP | 2005-9702 | A | 1/2005 |
| JP | 2005-29872 | A | 2/2005 |
| JP | 2006-266615 | A | 10/2006 |
| JP | 2008-81781 | A | 4/2008 |
| JP | 2008-274363 | A | 11/2008 |
| JP | 2008-280610 | A | 11/2008 |
| JP | 2009-102671 | A | 5/2009 |
| JP | 2014-51695 | A | 3/2014 |
| WO | 2007/113920 | A1 | 10/2007 |
| WO | 2012/063926 | A1 | 5/2012 |

* cited by examiner

HEAT TREATMENT APPARATUS

CROSS-REFERENCE TO RELATED APPLICATION

This application is a continuation application based on PCT Patent Application No. PCT/JP2016/057012, filed on Mar. 7, 2016, whose priority is claimed on Japanese Patent Application No. 2015-106336, filed May 26, 2015. The contents of both the PCT Patent Application and the Japanese Patent Applications are incorporated herein by reference.

TECHNICAL FIELD

The present disclosure relates to a heat treatment apparatus.

BACKGROUND ART

The following Patent Document 1 discloses a multi-chamber evacuate heating furnace in which a heating chamber and a cooling chamber are disposed adjacent to each other with a partition interposed therebetween. This multi-chamber evacuate heating furnace is a multi-chamber type multi-cooling evacuate furnace that blows a cooling gas against an article to be heat-treated from a plurality of gas nozzles provided so as to surround the article to be heat-treated within the cooling chamber, thereby cooling the article to be heat-treated.

Meanwhile, the following Patent Document 2 discloses a multi-chamber type heat treatment apparatus that has three heating chambers and one cooling chamber disposed therein with an intermediate conveyance chamber interposed therebetween, and moves a treating target among the three heating chambers and one cooling chamber via the intermediate conveyance chamber, thereby performing desired heat treatment on the treating target. The cooling chamber in this multi-chamber type heat treatment apparatus is disposed below the intermediate conveyance chamber and cools the treating target, which is carried in from the intermediate conveyance chamber by an exclusive lifting device, using a liquid or mist-like cooling medium.

CITATION LIST

Patent Document

[Patent Document 1] Japanese Unexamined Patent Application, First Publication No. H11-153386

[Patent Document 2] Japanese Unexamined Patent Application, First Publication No. 2014-051695

SUMMARY

Technical Problem

Meanwhile, the multi-chamber type heat treatment apparatus disclosed in Patent Document 2 is of a type in which the liquid or mist-like cooling medium is used, and a multi-chamber type heat treatment apparatus of a cooling type (gas cooling type) using gas as the cooling medium has not been developed in the multi-chamber type heat treatment apparatus of the type including the intermediate conveyance chamber. In the heat treatment apparatus of a type in which a heated treating target is cooled using gas without being limited to the gas cooling multi-chamber type heat treatment apparatus having the above intermediate conveyance chamber, it is common sense to use an inert gas as the cooling gas. However, if the cooling gas is limited to the inert gas, the degree of freedom of selection of the cooling gas decreases extremely.

The present disclosure has been made in view of the above-described problems, and an object thereof is to enhance the degree of freedom of selection of a cooling gas while realizing desired heat treatment on a treating target, in a case where a gas cooling type is adopted in a heat treatment apparatus.

Solution to Problem

The present disclosure includes the following configuration as means for solving the above problem.

A first aspect of the present disclosure is a heat treatment apparatus configured such that a treating target is conveyed via an intermediate conveyance chamber and accommodated in a heating chamber. The heat treatment apparatus includes a gas cooling chamber that is disposed adjacent to the intermediate conveyance chamber and cools the treating target using a cooling gas containing an oxidizer.

According to the heat treatment apparatus of the present disclosure, the gas cooling chamber that cools the treating target with the cooling gas containing an oxidizer is included. Even in a case where the cooling gas containing an oxidizer is used as in the present disclosure, the treating target can be cooled without causing such grain boundary oxidation which does not satisfy desired resistance, in a surface layer of the treating target. Hence, according to the present disclosure, the treating target can be cooled using the cooling gas containing an oxidizer, and it is possible to enhance the degree of freedom of selection of the cooling gas while realizing desired heat treatment on the treating target.

DESCRIPTION OF EMBODIMENTS

Hereinafter, an embodiment of the heat treatment apparatus related to the present disclosure will be described with reference to the drawings. In addition, in the following drawings, scales of respective members are appropriately changed in order to make the respective members have recognizable sizes.

Figure 1:
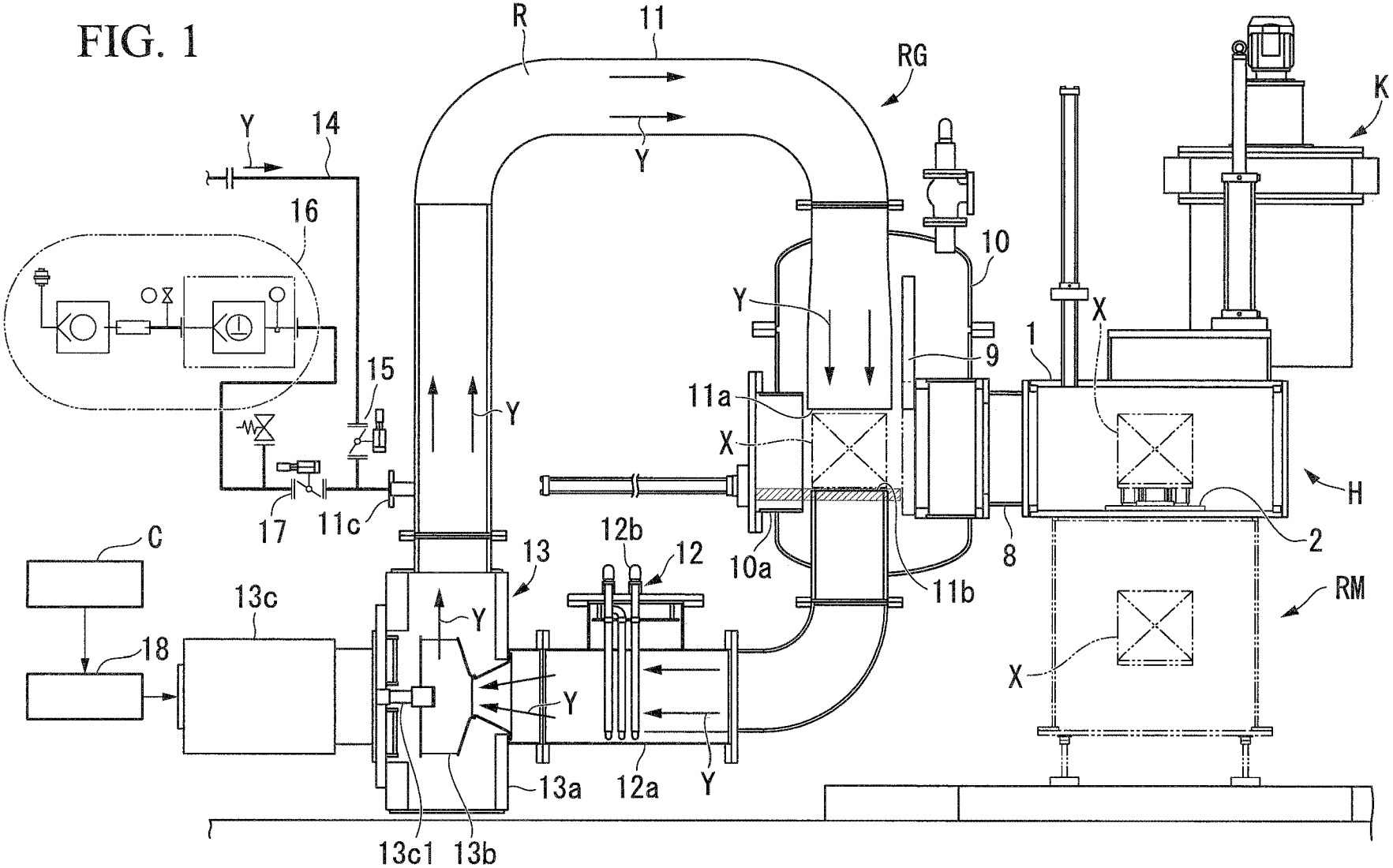
FIG. 1 is a longitudinal sectional view of a multi-chamber type heat treatment apparatus related to an embodiment of the present disclosure as seen from the front.

As shown in FIG. 1, a multi-chamber type heat treatment apparatus (heat treatment apparatus) related to the present embodiment is an apparatus in which a gas cooling device RG, a mist cooling device RM, and three heating devices K are combined together via an intermediate conveying device H. In addition, an actual multi-chamber type heat treatment apparatus includes the three heating devices K connected to the intermediate conveying device H. However, in FIG. 1, only one heating device K is shown because a longitudinal section at the center of the gas cooling device RG and the center of the intermediate conveying device H is shown in a plan view of the multi-chamber type heat treatment apparatus. Additionally, this multi-chamber type heat treatment apparatus includes an evacuate pump, various pipes, various valves, various lifting mechanisms, a control panel, a control device, and the like as constituent elements that are not shown in FIGS. 1 to 4.

Figure 2:
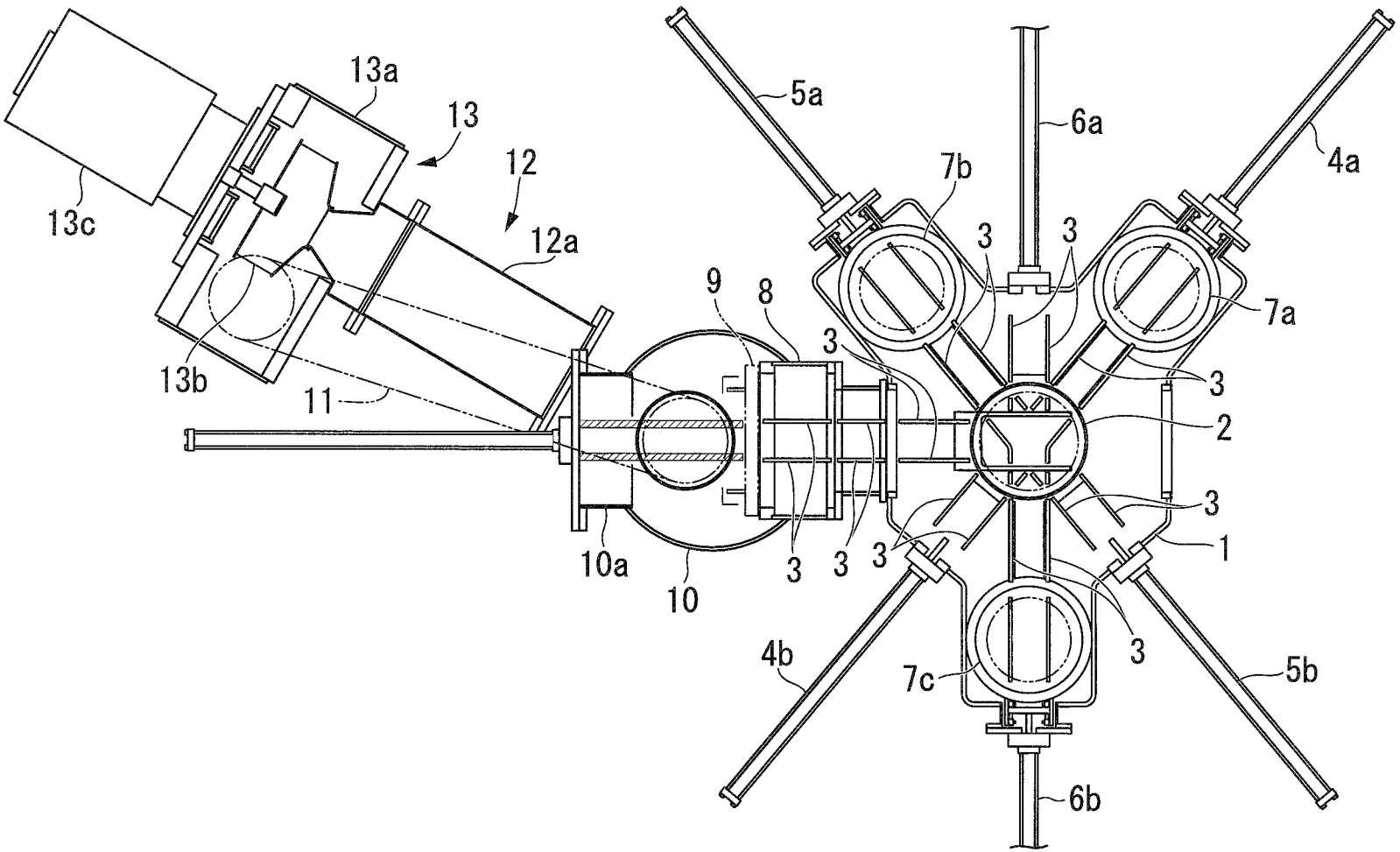
FIG. 2 is a cross-sectional view of the multi-chamber type heat treatment apparatus related to the embodiment of the present disclosure as seen from the top.

As shown in FIGS. 1 and 2, the intermediate conveying device H includes a conveyance chamber 1, a mist cooling chamber lifting platform 2, a plurality of conveyance rails 3, three pairs of pusher mechanisms 4*a* and 4*b*; 5*a* and 5*b*; and 6*a* and 6*b*, three heating chamber lifting platforms 7*a* to 7*c*, an extended chamber 8, a partition door 9, and the like.

The conveyance chamber 1 is a container provided between the mist cooling device RM and the three heating devices K. As shown in FIG. 2, the three heating chamber lifting platforms 7*a* to 7*c* are disposed at a floor part of the conveyance chamber 1 so as to surround the mist cooling chamber lifting platform 2. An internal space of such a conveyance chamber 1 and an internal space of the extended chamber 8 to be described below are intermediate conveyance chambers in which a treating target X, such as a metal component, moves.

The mist cooling chamber lifting platform 2 is a supporting platform on which the treating target X is placed when the treating target X is cooled with the mist cooling device RM, and is raised and lowered by lifting mechanism (not shown). That is, the above lifting mechanisms operate in a state where the treating target X is placed on the mist cooling chamber lifting platform 2, and thus, the treating target X moves between the intermediate conveying device H and the mist cooling chamber lifting platform 2.

As shown in the drawings, the plurality of conveyance rails 3 are laid on the floor part of the conveyance chamber 1, on the mist cooling chamber lifting platform 2, on the heating chamber lifting platforms 7*a* to 7*c*, and on the floor part of the extended chamber 8. Such conveyance rails 3 are guide members when the treating target X is moved within the conveyance chamber 1 and the extended chamber 8. The three pairs of pusher mechanisms 4*a* and 4*b*; 5*a* and 5*b*; and 6*a* and 6*b* are conveying actuators that press the treating target X within the conveyance chamber 1 and the extended chamber 8.

That is, a pair of pusher mechanisms 4*a* and 4*b*, which are disposed in the same straight line, among the three pairs of pusher mechanisms 4*a* and 4*b*; 5*a* and 5*b*; and 6*a* and 6*b*, moves the treating target X between the mist cooling chamber lifting platform 2 and the heating chamber lifting platform 7*a*. One pusher mechanism 4*a* out of the pair of pusher mechanisms 4*a* and 4*b* presses the treating target X toward the mist cooling chamber lifting platform 2 from the heating chamber lifting platform 7*a*, and the other pusher mechanism 4*b* presses the treating target X toward the heating chamber lifting platform 7*a* from the mist cooling chamber lifting platform 2.

Similarly, a pair of pusher mechanisms 5*a* and 5*b*, which are disposed in the same straight line, moves the treating target X between the mist cooling chamber lifting platform 2 and the heating chamber lifting platform 7*b*. One pusher mechanism 5*a* out of the pair of pusher mechanisms 5*a* and 5*b* presses the treating target X toward the mist cooling chamber lifting platform 2 from the heating chamber lifting platform 7*b*, and the other pusher mechanism 5*b* presses the treating target X toward the heating chamber lifting platform 7*b* from the mist cooling chamber lifting platform 2.

Additionally, a pair of pusher mechanisms 6*a* and 6*b*, which are disposed in the same straight line, moves the treating target X between the mist cooling chamber lifting platform 2 and the heating chamber lifting platform 7*c*. That is, one pusher mechanism 6*a* out of the pair of pusher mechanisms 6*a* and 6*b* presses the treating target X toward the mist cooling chamber lifting platform 2 from the heating chamber lifting platform 7*c*, and the other pusher mechanism 6*b* presses the treating target X toward the heating chamber lifting platform 7*c* from the mist cooling chamber lifting platform 2.

The plurality of conveyance rails 3 described above also guides the movement of pressing parts attached to tips of the three pairs of pusher mechanisms 4*a* and 4*b*; 5*a* and 5*b*; and 6*a* and 6*b*, in addition to guiding the treating target X so as to move smoothly, when the treating target X are moved (conveyed) using these three pairs of pusher mechanisms 4*a* and 4*b*; 5*a* and 5*b*; and 6*a* and 6*b* as power sources.

The three heating chamber lifting platforms 7*a* to 7*c* are supporting platforms on which the treating target X is placed when the treating target X is heat-treated with the respective heating devices K, and are provided immediately below the respective heating devices K. Such heating chamber lifting platforms 7*a* to 7*c* are raised and lowered by the lifting mechanisms (not shown), thereby moving the treating target X between the intermediate conveying device H and the respective heating devices K.

The extended chamber 8 is a substantially box-shaped extended container that is connected to a side part of the conveyance chamber 1 and that is provided for convenience in order to connect the intermediate conveying device H and the gas cooling device RG together. First end (one plane) of the extended chamber 8 communicates with the side part of the conveyance chamber 1, and the second end (one plane) of the extended chamber 8 is provided with the partition door 9. The conveyance rails 3 are laid on the floor part of such an extended chamber 8 such that the treating target X are movable thereon.

The partition door 9 is an opening and closing door that partitions the intermediate conveyance chambers that are the internal spaces of the conveyance chamber 1 and the extended chamber 8 and a gas cooling chamber that is the internal space of the gas cooling device RG, and is provided in a perpendicular posture at the second end (one plane) of the extended chamber 8. That is, the partition door 9 moves up and down with a driving mechanism (not shown), thereby opening or covering the second end of the extended chamber 8.

Subsequently, the gas cooling device RG will be described. The gas cooling device RG is a cooling device that cools the treating target X using a cooling gas Y that is a gas containing an oxidizer. As the cooling gas Y, air (that is, ambient air) outside the multi-chamber type heat treatment apparatus can be used. Additionally, air whose temperature or humidity adjusted can also be used. In addition, in the multi-chamber type heat treatment apparatus of the present embodiment, it is also possible to use a mixed gas containing oxygen that acts on the treating target X as an oxidizer, that is, carbon dioxide or the like in addition to air, which is a gas containing an oxidizer, as the cooling gas. Additionally, the proportion of the oxygen mixed with the above cooling gas may be appropriately changed.

However, the cooling gas Y can be easily and cheaply supplied by using ambient air as the cooling gas Y. As shown in FIG. 1, such a gas cooling device RG includes a cooling chamber 10 (gas cooling chamber), a circulation chamber 11, a gas cooler 12, a blower 13, a cooling gas introduction pipe 14, a first control valve 15, an exhaust pump 16, a second control valve 17, a power supply device 18, and the like.

In addition, the circulation chamber 11 (gas cooling chamber), the gas cooler 12, the blower 13, the cooling gas introduction pipe 14, the first control valve 15, the exhaust pump 16, the second control valve 17, and the power supply device 18, excluding the cooling chamber 10 among the plurality of constituent elements constitute a cooling gas distribution mechanism that blows the cooling gas against the treating target X within the cooling chamber 10 from above and exhausts the cooling gas, which has contributed to the cooling of the treating target X, from below the treating target X.

The cooling chamber 10 is a container having a rounded, substantially vertical cylindrical shape and having a horizontal cross-sectional shape of a substantially circular (annular) shape, and is provided adjacent to the extended chamber 8 that constitutes an intermediate conveyance chamber. The internal space of the cooling chamber 10 is a gas cooling chamber that blows a predetermined cooling gas against the treating target X, thereby performing cooling processing on the treating target X. In addition, the shape of the cooling chamber 10 is formed in a high pressure-resistance shape, that is, a rounded, substantially cylindrical shape so as to withstand a positive internal pressure of 500 kPa or more.

Additionally, the cooling chamber 10 is connected to the extended chamber 8 in a state where a portion of the extended chamber 8 is taken in, that is, the partition door 9 protrudes inward from a side into the gas cooling chamber. Moreover, a workpiece inlet/outlet 10*a* is provided at a position that faces the partition door 9 in the cooling chamber 10. The workpiece inlet/outlet 10*a* is an opening for allowing the treating target X to be taken in and out between the outside and the gas cooling chamber.

Figure 3:
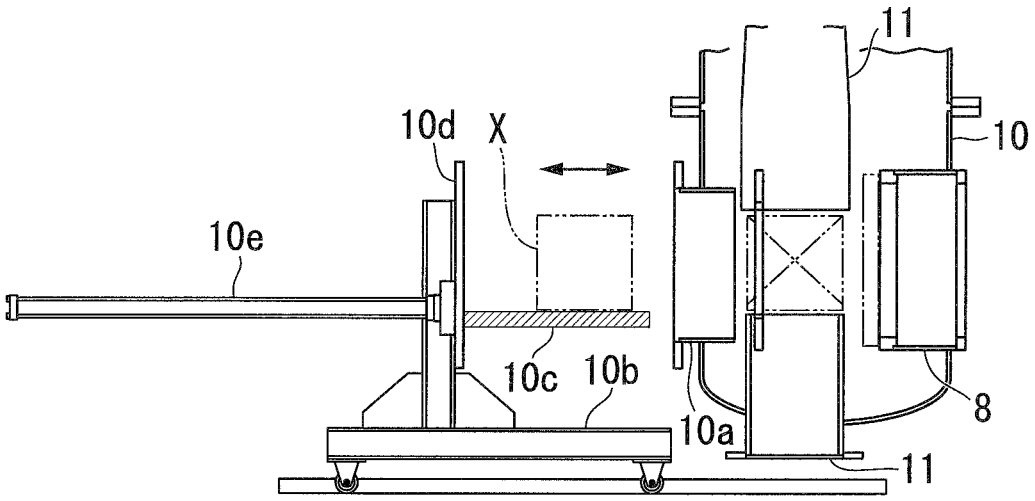
FIG. 3 is a longitudinal sectional view showing taking in and out of a treating target in the multi-chamber type heat treatment apparatus related to the embodiment of the present disclosure.

As shown in FIG. 3, the treating target X is accommodated within the cooling chamber 10 from the workpiece inlet/outlet 10*a* in a state where the object X is loaded on a conveying carriage 10*b*. The conveying carriage 10*b* includes a placement platform 10*c* that holds the treating target X at a predetermined height, and is movable forward and backward with respect to the workpiece inlet/outlet 10*a*. That is, the conveying carriage 10*b* moves along carriage rails laid on a floor surface of a building on which the multi-chamber type heat treatment apparatus is installed, and thus, is capable of being brought close to and separated from the cooling chamber 10.

Additionally, the conveying carriage 10*b* is provided with a closing plate 10*d*, and a cylinder mechanism 10*e* for entrance and exit. The closing plate 10*d* is a plate-like member that abuts against the workpiece inlet/outlet 10*a* to seal the workpiece inlet/outlet when the treating target X is accommodated within the cooling chamber 10. The closing plate 10*d* seals the workpiece inlet/outlet 10*a*, for example, by being bolted into the workpiece inlet/outlet 10*a* in a state where the closing plate abuts against the workpiece inlet/outlet 10*a*.

The cylinder mechanism 10*e* for entrance and exit is a conveying mechanism that moves the treating target X within a cooling chamber (cooling chamber 10) and the conveyance chamber 1 (intermediate conveyance chamber). That is, the cylinder mechanism 10*e* for entrance and exit is a pusher and puller conveying mechanism that presses the treating target X on the placement platform 10*c*, thereby moving the treating target X onto the mist cooling chamber lifting platform 2 within the intermediate conveyance chamber and that is engaged with the treating target X on the mist cooling chamber lifting platform 2 to pull the treating target X, thereby moving the treating target X onto the placement platform 10*c* from the inside of the intermediate conveyance chamber.

Here, as shown in FIG. 2, in the conveyance chamber 1, it is possible to provide an opening for allowing the treating target X to enter and exit on a side opposite to the extended chamber 8. Hence, instead of the cooling chamber 10, the workpiece inlet/outlet may be provided on the side opposite to the extended chamber 8. In addition, in this case, the pusher and puller conveying mechanism having the same function as the cylinder mechanism 10*e* for entrance and exit is fixedly disposed in the cooling chamber 10, the workpiece inlet/outlet provided in the conveyance chamber 1 is provided with an exclusive opening and closing door, and the treating target X is carried into the conveyance chamber 1 (intermediate conveyance chamber) from the workpiece inlet/outlet using the conveying carriage that is separately prepared, and is placed on the mist cooling chamber lifting platform 2.

In a configuration in which the conveyance chamber 1 is provided with the workpiece inlet/outlet in this way, it is possible to fixedly install the conveying mechanism equivalent to the cylinder mechanism 10*e* for entrance and exit in the multi-chamber type heat treatment apparatus. Thus it is possible to guarantee the usability and durability of the multi-chamber type heat treatment apparatus.

The circulation chamber 11 is open to a lower part (lower side) of the cooling chamber 10 such that one circular end (gas blow-in port 11*a*) is open to an upper part (upper side) of the cooling chamber 10 with the substantially vertical cylindrical shape and similarly the other circular end (gas exhaust port 11*b*) faces a gas blow-in port 11*a* with the treating target X therebetween. Such a circulation chamber 11 is a container that connects the cooling chamber 10, the gas cooler 12, and the blower 13 together in an annular shape as a whole. That is, the cooling chamber 10, the circulation chamber 11, the gas cooler 12, and the blower 13 form a gas circulation path R that allows the cooling gas Y to be circulated therethrough such that the cooling gas Y flows downward from the gas blow-in port 11*a*, that is, flows toward the gas exhaust port 11*b*.

In such a gas circulation path R, a clockwise flow of the cooling gas Y is generated as indicated by an arrow in FIG. 1 due to the operation of the blower 13. Additionally, the treating target X is disposed between the above-described gas blow-in port 11*a* and gas exhaust port 11*b*. The cooling gas Y blown out downward from the gas blow-in port 11*a* is blown against the treating target X from above, and the treating target X is cooled. Then, the cooling gas Y that has contributed to the cooling of the treating target X is recovered in the circulation chamber 11 by flowing out below the treating target X and flowing into the gas exhaust port 11*b*.

Here, as shown in FIG. 1, the gas blow-in port 11*a* extends up to immediately above the treating target X within the gas cooling chamber, and the gas exhaust port 11*b* extends up to immediately below the treating target X within the gas cooling chamber. Hence, the cooling gas Y blown out from the gas blow-in port 11*a* is mostly blown against the treating target X without being dispersed within the gas cooling chamber, and the cooling gas Y that has contributed to the cooling of the treating target X is similarly recovered in the circulation chamber 11 without being dispersed within the gas cooling chamber.

Additionally, as shown in FIGS. 1 and 2, the positions of the circular gas blow-in port 11*a* and the circular gas exhaust port 11*b* in a horizontal direction with respect to the substantially circular cooling chamber 10 are not concentric but the centers thereof are displaced. That is, although the center of the gas blow-in port 11*a* and the center of the gas exhaust port 11*b* in the horizontal direction are concentric with each other, the center of the gas blow-in port 11*a* and the center of the gas exhaust port 11*b* are displaced to the workpiece inlet/outlet 10*a*, that is, the side opposite to the partition door 9 from the center of the cooling chamber 10.

Here, as described above, the extended chamber 8 is connected to the cooling chamber 10 in a state where the partition door 9 protrudes inward from a side into the gas cooling chamber, but secures the pressure resistance of the cooling chamber 10. That is, although the extended chamber 8 and the cooling chamber 10 are connected together by welding, if the partition door 9 is brought close to a side wall of the cooling chamber 10, a welding line becomes complicated and it becomes difficult to guarantee sufficient welding quality. Under such circumstances, the extended chamber 8 is connected to the cooling chamber 10 in a state where the partition door 9 protrudes inward from a side into the gas cooling chamber, that is, in a state where a portion of the extended chamber 8 is taken in.

However, the gas blow-in port 11*a* and the gas exhaust port 11*b* cannot be located concentrically with the cooling chamber 10 because the partition door 9 protrudes from a side into the gas cooling chamber. Here, it is possible to make the cooling chamber 10 have a larger diameter, that is, to enlarge the cooling chamber 10, thereby locating the gas blow-in port 11*a* and the gas exhaust port 11*b* concentrically with the cooling chamber 10. In this case, however, the volume of the gas cooling chamber (cooling space) increases, and cooling efficiency decreases. Hence, the diameter of the cooling chamber 10 is made as small as possible by displacing the gas blow-in port 11*a* and the gas exhaust port 11*b* with respect to the cooling chamber 10.

The gas cooler 12 is a heat exchanger that is provided on a downstream side of the gas exhaust port 11*b* and on an upstream side of the blower 13 in the above-described gas circulation path R and comprises of a gas cooling chamber 12*a* and a heat transfer pipe 12*b*. The gas cooling chamber 12*a* is a tubular body that has the first end communicating with the circulation chamber 11 and the second end communicating with the blower 13. The heat transfer pipe 12*b* is a metal pipe that is provided in a meandering state into such a gas cooling chamber 12*a*, and allows a predetermined liquid refrigerant to pass therethrough. Such a gas cooler 12 is cooled by exchanging the cooling gas Y flowing from the first end of the circulation chamber 11 to the second end with the liquid refrigerant within the heat transfer pipe 12*b*. A drain discharge mechanism (not shown) for discharging drain water accumulated at a lower part of the gas cooling chamber 12*a* is installed at a lower part of this gas cooler 12.

Here, the cooling gas Y that has contributed to the cooling of the treating target X in the cooling chamber 10 (gas cooling chamber) is heated with the heat that the treating target X holds, the treating target X being exhausted from the cooling chamber 10, that is, the gas cooling chamber. The gas cooler 12 cools the cooling gas Y heated in this way, for example, to a temperature (the temperature of the cooling gas Y blown out from the gas blow-in port 11*a*) before being used for the cooling of the treating target X.

The blower 13 is provided in the middle of the above-described gas circulation path R, that is, on a downstream side of the gas cooler 12, and includes a fan casing 13*a*, a turbofan 13*b* (fan), and a water-cooled motor 13*c* (motor). The fan casing 13*a* is a tubular body that has first end communicating with the gas cooling chamber 12*a* and the second end communicating with the circulation chamber 11. The turbofan 13*b* is a centrifugal fan that is accommodated within such a fan casing 13*a*. The water-cooled motor 13*c* is a drive part that rotates such a turbofan 13*b*. As shown in FIG. 1, the water-cooled motor 13*c* has a motor shaft 13*c*1 connected to the water-cooled motor 13*c*. By supplying electric power from the power supply device 18 to such a water-cooled motor 13*c*, rotational power is generated, the rotational power is transmitted to the turbofan 13*b* via the motor shaft 13*c*1, and thus, the turbofan 13*b* is rotationally driven.

Figure 4:
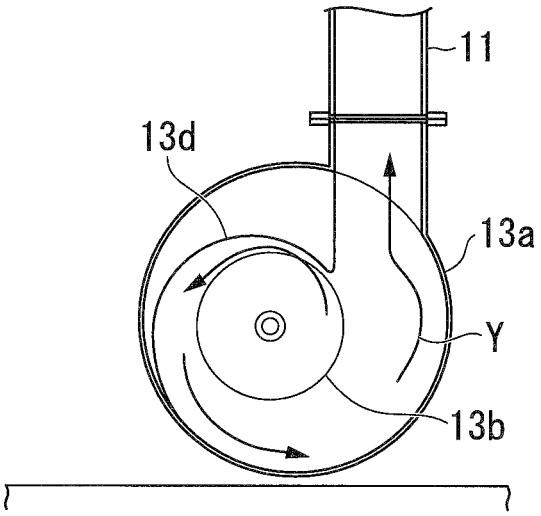
FIG. 4 is a longitudinal sectional view showing a blower in the multi-chamber type heat treatment apparatus related to the embodiment of the present disclosure.

As shown in FIGS. 1 and 4, the gas cooling chamber 12*a* is a horizontally placed, substantially cylindrical container, and a rotational axis of the turbofan 13*b* is set to the horizontal direction similarly to a central axis of the gas cooling chamber 12*a*. Additionally, as shown in FIG. 4, the rotational axis of the turbofan 13*b* is provided at a position displaced by a predetermined dimension in the horizontal direction from the central axis of the gas cooling chamber 12*a*. Moreover, as shown in FIG. 4, a guide plate 13*d*, which throttles an upper flow passage of the turbofan 13*b* and smoothly expands the flow passage in the counterclockwise direction, is provided within the gas cooling chamber 12*a*.

In such a blower 13, as shown in FIG. 4, as the water-cooled motor 13*c* operates and the turbofan 13*b* rotates counterclockwise, the cooling gas Y flows as indicated by an arrow. That is, in the blower 13, the cooling gas Y is sucked from a first end of the fan casing 13*a* located in front of the rotational axis of the turbofan 13*b* and is sent out in the counterclockwise direction. Moreover, by guiding the cooling gas Y with the guide plate 13*d*, the cooling gas is sent out from a second end of the fan casing 13*a* located in a direction orthogonal to the rotational axis of the turbofan 13*b*. As a result, a clockwise flow of the cooling gas Y as indicated by an arrow in FIG. 1 generated in the gas circulation path R by operating the blower 13.

In this way, the gas circulation path R is formed by interposing the gas cooling chamber 12*a* and the fan casing 13*a* in the middle of the circulation chamber 11. In more detail, the gas circulation path R is formed by interposing the gas cooling chamber 12*a* so as to be located on an upstream side of the fan casing 13*a* in a flow direction of the cooling gas Y. Additionally, a supply and exhaust port 11*c* is provided on a downstream side of the fan casing 13*a* in the circulation chamber 11 that forms such a gas circulation path R.

The cooling gas introduction pipe 14 is a pipe connected to the supply and exhaust port 11*c*, and is a pipe for introducing ambient air (that is, the cooling gas Y) into the gas circulation path R in the present embodiment from the outside of the multi-chamber type heat treatment apparatus. For example, a filter (not shown) for removing foreign matter contained in the ambient air is installed at an inlet of the cooling gas introduction pipe 14. In addition, as described above, in a case where air or other gas whose temperature or humidity is controlled is used as the cooling gas Y instead of the ambient air, a reserve tank for holding this gas is connected to the cooling gas introduction pipe 14. In addition, in a case where the reserve tank is installed, it is preferable to fill gas into the reserve tank with a pressure sufficiently higher than a supply pressure (the atmospheric pressure in the present embodiment) in the present embodiment when the cooling gas Y is supplied to the gas circulation path R. This makes it possible to supply gas to the gas circulation path R in a short time. In a case where gas is kept at high pressure in the reserve tank in this way, the atmospheric air or the ambient air from which steam is removed by a dryer or the like may be filled by a compressor. In addition, the atmospheric pressure herein means the pressure of the atmospheric air in a place where the multi-chamber type heat treatment apparatus of the present embodiment is installed.

The first control valve 15 is an on-off valve that allows and blocks passage of the cooling gas Y. That is, in a case where the first control valve 15 is in a closed state, supply of the cooling gas Y from the cooling gas introduction pipe 14 to the supply and exhaust port 11*c* is blocked, and in a case where the first control valve 15 is in an open state, the cooling gas Y is supplied from the cooling gas introduction pipe 14 to the supply and exhaust port 11*c*. The cooling gas introduction pipe 14 and the first control valve 15 are equivalent to cooling gas supply means of the present disclosure configured to supply the cooling gas Y to the cooling chamber 10 through the circulation chamber 11.

The exhaust pump 16 is connected to the supply and exhaust port 11*c* via the second control valve 17, and exhausts the cooling gas Y within the gas circulation path R to the outside via the supply and exhaust port 11*c*. The second control valve 17 is an on-off valve that determines the flow of the cooling gas Y from the supply and exhaust port 11*c* to the exhaust pump 16. That is, in a case where the second control valve 17 is in the closed state, the flow (exhaust) of the cooling gas Y from the supply and exhaust port 11*c* to the exhaust pump 16 is blocked, and in a case where the second control valve 17 is in the open state, the flow of the cooling gas Y from the supply and exhaust port 11*c* to the exhaust pump 16 is allowed. The exhaust pump 16 and the second control valve 17 are equivalent to an exhaust device of the present disclosure that evacuates the cooling chamber 10 through the circulation chamber 11.

The power supply device 18 supplies electric power to the water-cooled motor 13*c* of the blower 13 under the control of the control device C, and is electrically connected to the water-cooled motor 13*c*. The power supply device 18 makes it possible to adjust a driving voltage applied to the water-cooled motor 13*c*, and makes a driving voltage applied to the water-cooled motor 13*c* at the start of supply of the cooling gas Y to the gas circulation path R lower than a driving voltage applied to the water-cooled motor 13*c* after the supply of the cooling gas Y to the gas circulation path R is completed, under the control of the control device C.

Subsequently, the mist cooling device RM is a device that cools the treating target X using mist as a predetermined cooling medium, and is provided below the conveyance chamber 1. The mist cooling device RM sprays the mist as the cooling medium from a plurality of nozzles provided around the treating target X to the treating target X, which is accommodated within the chamber in a state where the treating target X is placed on the above-described mist cooling chamber lifting platform 2, thereby cooling (mist-cooling) the treating target X. In addition, an internal space of such a mist cooling device RM is a mist cooling chamber, and the cooling medium is water.

The three heating devices K are devices that heat-treat the treating target X, and are provided above the conveyance chamber 1. Each of the heating devices K includes a chamber, a plurality of electric heaters, an evacuate pump, and the like. The treating target X accommodated within the chamber in a state where the treating target X is placed on the heating chamber lifting platforms 7*a* to 7*c* by using the evacuate pump is placed in a predetermined pressure-reduced atmosphere, and the treating target X is uniformly heated with a plurality of heaters provided around the treating target X in the pressure-reduced atmosphere. In addition, the internal space of each heating device K is an individual heating chamber.

Additionally, the multi-chamber type heat treatment apparatus of the present embodiment includes the control panel (not shown) to which an operator inputs setting information, such as heat-treatment conditions, and the control device C that controls the respective pusher mechanisms 4*a* and 4*b*; 5*a* and 5*b*; and 6*a* and 6*b*, the partition door 9, the first control valve 15, the exhaust pump 16, the second control valve 17, the power supply device 18, and the like on the basis of the above setting information and control programs stored in advance, as electrical constituent elements.

In the multi-chamber type heat treatment apparatus of the present embodiment, the control device C evacuates the cooling chamber 10 using the exhaust pump 16 and the second control valve 17 before the treating target X is carried into the cooling chamber 10. Additionally, the control device C causes the cooling gas introduction pipe 14 and the first control valve 15 to supply the cooling gas Y to the cooling chamber 10 after the treating target X is carried into the cooling chamber 10. In this case, the control device C starts the blower 13 before the cooling gas Y is supplied to the cooling chamber 10. Accordingly, when the cooling gas Y is supplied to the circulation chamber 11, the turbofan 13*b* of the blower 13 is first rotationally driven, and the cooling gas Y is supplied to the circulation chamber 11 and simultaneously the flow of the cooling gas Y is formed in the gas circulation path R. For this reason, the cooling rate of the treating target X can be improved.

Additionally, the control device C performs control such that the driving voltage of the blower 13 at the start of supply of the cooling gas Y to the cooling chamber 10 by the cooling gas introduction pipe 14 and the first control valve 15 becomes lower than the driving voltage of the blower 13 at the completion of supply of the cooling gas Y by the cooling gas introduction pipe 14 and the first control valve 15. Accordingly, even if the water-cooled motor 13*c* is driven when the gas circulation path R is in an evacuate state, electrical discharge can be prevented from occurring in the water-cooled motor 13*c*.

As described above, in the multi-chamber type heat treatment apparatus related to the present embodiment, the three (a plurality of) heating devices K are disposed across the conveyance chamber 1 in a top view, and the treating target X is accommodated in each heating device K via the conveyance chamber 1. Additionally, the multi-chamber type heat treatment apparatus related to the present embodiment includes the cooling chamber 10 provided adjacent to the conveyance chamber 1 in the top view, and is enabled to cool the treating target X in the cooling chamber 10.

Next, the operation of the multi-chamber type heat treatment apparatus configured in this way, particularly, the cooling operation of the treating target X in the gas cooling device RG (gas cooling chamber) will be described in detail. In addition, in the following, the operation in a case where quenching treatment is performed on the treating target X, using one heating device K (heating chamber) and the gas cooling device RG (gas cooling chamber), will be described as an example of heat treatment of the treating target X by the multi-chamber type heat treatment apparatus.

First, an operator manually operates the conveying carriage 10*b*, thereby carrying the treating target X into the cooling chamber 10 (gas cooling chamber). Then, the operator bolts the closing plate 10*d* to the workpiece inlet/outlet 10*a* and seals the workpiece inlet/outlet 10*a*, thereby ending preliminary work. Then, the operator manually operates the above control panel, thereby setting the heat-treatment conditions, and instructs the control device C to start heat treatment.

As a result, the control device C operates the evacuate pump connected to the conveyance chamber 1 or the like, and the exhaust pump 16 connected to the gas circulation path R, thereby turning the insides of the gas cooling chamber and the intermediate conveyance chamber, that is, the insides of the cooling chamber 10, the extended chamber 8, and the conveyance chamber 1 into a predetermined evacuate atmosphere, and further operates the cylinder mechanism 10*e* for entrance and exit, thereby moving the treating target X within the cooling chamber 10 onto the mist cooling chamber lifting platform 2 within the conveyance chamber 1. Then, the control device C, for example, operates the pusher mechanism 6*a*, thereby moving the treating target X onto the heating chamber lifting platform 7*c* and further moving the treating target X to a heating device K (heating chamber) located immediately above the heating chamber lifting platform 7*c* to cause the heating device to perform the heat treatment according the above heat-treatment conditions.

Then, the control device C operates the pusher mechanism 6*b*, thereby moving the treating target X, which has completed the heat treatment, onto the mist cooling chamber lifting platform 2 from the heating chamber lifting platform 7*c*, and further operates the cylinder mechanism 10*e* for entrance and exit, thereby moving the treating target X on the mist cooling chamber lifting platform 2 into the cooling chamber 10. In addition, during this movement, the control device C raises the partition door 9, thereby bringing the extended chamber 8 and the cooling chamber 10 into a communication state. If the movement of the treating target X to the cooling chamber 10 is completed, the partition door 9 is lowered and the communication state of the extended chamber 8 and the cooling chamber 10 is blocked. As a result, the cooling chamber 10 (gas cooling chamber) is completely isolated from the intermediate conveyance chamber.

As the partition door 9 is lowered to isolate the cooling chamber 10 in this way, the control device C applies a driving voltage to the power supply device 18, and starts the blower 13. That is, the control device C starts the blower 13 in a state where the gas circulation path R is evacuated. In addition, in a state where the cooling chamber 10 is evacuated, the inside of the water-cooled motor 13*c* of the blower 13 is brought into an evacuate state. For this reason, electrical discharge may occur by supplying electric power to the water-cooled motor 13*c*. Easy occurrence of electrical discharge is dependent on the height of the driving voltage. Hence, in the multi-chamber type heat treatment apparatus of the present embodiment, the control device C performs control such that the driving voltage of the blower 13 at the start of supply of the cooling gas Y to the cooling chamber 10 by the cooling gas introduction pipe 14 and the first control valve 15 becomes lower than the driving voltage of the blower 13 at the completion of supply of the cooling gas Y by the cooling gas introduction pipe 14 and the first control valve 15. Then, the control device C performs control such that the driving voltage of the blower 13 before the start of supply of the cooling gas Y become lower than the driving voltage of the blower 13 at the completion of supply of the cooling gas Y, similar to the driving voltage of the blower 13 at the start of supply of the cooling gas Y to the cooling chamber 10. This makes it possible to start the blower 13 before the supply of the cooling gas Y while suppressing the electrical discharge in the water-cooled motor 13*c*.

Additionally, in order to further suppress the electrical discharge in the water-cooled motor 13*c*, a driving voltage may be applied to the blower 13 after the supply of the cooling gas Y to the cooling chamber 10 is started. For example, the blower 13 may be started after the pressure of the gas circulation path R reaches 20 kPa to 50 kPa. Accordingly, since supply of electric power to the blower 13 is performed after the cooling gas Y flows into the inside of the water-cooled motor 13*c*, the electrical discharge in the water-cooled motor 13*c* can be further suppressed. However, in such a case, the blower 13 is started after waiting for the inflow of the cooling gas Y into the water-cooled motor 13*c*. For this reason, the time until forming a circulatory flow of the cooling gas Y becomes long, and the cooling rate of the treating target X is slightly delayed as compared with a case where the water-cooled motor 13*c* is started before the inflow of the cooling gas Y.

Subsequently, the control device C changes the state of the first control valve 15 from the closed state to the open state and sets the second control valve 17 to the closed state, thereby starting the supply of the cooling gas Y from the supply and exhaust port 11*c* into the gas circulation path R. Then, if a predetermined amount of the cooling gas Y is supplied into the gas circulation path R, the control device C changes the state of the first control valve 15 from the open state to the closed state, raises the driving voltage applied to the water-cooled motor 13*c* to circulate the cooling gas Y, and starts the supply of the liquid refrigerant to the heat transfer pipe 12*b*, thereby cooling the treating target X.

In such cooling processing of the treating target X in the gas cooling device RG, the treating target X is located immediately below the gas blow-in port 11*a* and immediately above the gas exhaust port 11*b*. Thus, the cooling gas Y is blown against the treating target X from immediately above the treating target X, and the cooling gas Y, which has contributed to the cooling, flows out from immediately below the treating target X and flows into the gas exhaust port 11*b*.

That is, the cooling gas Y, which has flowed from the gas blow-in port 11*a* to immediately above the treating target X, exclusively contributes to the cooling of the treating target X without substantially diffusing into a region other than the treating target X within the cooling chamber 10 (gas cooling chamber), and is exhausted from immediately below the treating target X to the circulation chamber 11. Hence, according to the gas cooling device RG, since most of the cold that the cooling gas Y has is used for the cooling of the treating target X, efficient gas cooling can be realized.

Here, in the gas cooling device RG, cooling efficiency is improved as much as possible by extending the gas blow-in port 11*a* to immediately above the treating target X and extending the gas exhaust port 11*b* to immediately below the treating target X, within the cooling chamber 10 (gas cooling chamber). However, the distance between the gas blow-in port 11*a* and the treating target X, and the distance between the gas exhaust port 11*b* and the treating target X may be made somewhat larger. For example, in a case where objects X to be treated with various sizes are heat-treated by the gas cooling device RG, it is necessary to secure the distance between the gas blow-in port 11*a* and the treating target X, and the distance between the gas exhaust port 11*b* and the treating target X to some extent according to the size of the treating target X.

If such cooling of the treating target X using the cooling gas Y is completed, the control device C changes the state of the second control valve 17 from the closed state to the open state and operates the exhaust pump 16, thereby exhausting the cooling gas Y within the gas circulation path R from the supply and exhaust port 11*c* to the outside. Accordingly, since cooling gas Y is eliminated from the inside of the gas circulation path R and the inside of the gas cooling chamber, the closing plate 10*d* can be made to be able to release from the workpiece inlet/outlet 10*a*, and the treating target X can be carried out from the workpiece inlet/outlet 10*a* to the outside.

Additionally, according to the gas cooling device RG, by providing the gas circulation path R, the cooling gas Y heated by being used for the cooling of the treating target X is cooled and reused for the cooling of the treating target X. Thus, the amount of the cooling gas Y used can be markedly reduced as compared with a case where the cooling gas Y used for the cooling of the treating target X is discarded.

According to the multi-chamber type heat treatment apparatus of the present embodiment as described above, the cooling chamber 10 that cools the treating target X with the cooling gas Y containing an oxidizer is included. In the cooling of the treating target by the mist cooling using steam, it is confirmed that grain boundary oxidation does not occur in a surface layer of the treating target, irrespective of containing the oxidizer (oxygen) in steam, and the resistance of the treating target does not decrease. For this reason, even in a case where the cooling gas containing an oxidizer is used as in the multi-chamber type heat treatment apparatus of the present embodiment, the treating target X can be cooled without causing such grain boundary oxidation which does not satisfy desired resistance, in the surface layer of the treating target X. Hence, according to the multi-chamber type heat treatment apparatus of the present embodiment, the treating target X can be cooled using the cooling gas containing an oxidizer, and it is possible to enhance the degree of freedom of selection of the cooling gas while realizing desired heat treatment on the treating target X.

In addition, in the multi-chamber type heat treatment apparatus of the present embodiment, operation conditions (the temperature, flow rate, and cooling time of the cooling gas Y) is determined in advance by experiment such that the grain boundary oxidation does not occur in the treating target X. Here, the grain boundary oxidation means a phenomenon in which grain boundaries of a metallic surface layer are oxidized by oxygen in a high-temperature environment and oxides adhere to the grain boundaries. Additionally, it is also known that the resistance of a metal surfaces decreases as the grain boundary oxidation occurs. Then, in the case of the present disclosure, the operation conditions in which the grain boundary oxidation does not occur for each type or number of the treating target X subjected to heat treatment are stored in the control device C, and controls operation on the conditions that the grain boundary oxidation does not occur if an operator inputs the type or number of the treating target X on the control panel or the like. Even in such a case, it is considered that the outermost surface layer of the treating target X is oxidized and the surface of the treating target X is colored. The coloring of the above the outermost surface layer indicates coloring in a range of angstrom order from the surface layer of the treating target X toward a deep portion thereof. Meanwhile, the grain boundary oxidation is a phenomenon in which grain boundaries of crystals on the surface of the treating target X are oxidized, and occurs in a range of tens of micrometers from the surface of the treating target X in a depth direction thereof. In a case where the grain boundary oxidation has occurred, the treating target X is affected in the way of such as decrease of resistance. However, in case of coloring since the coloring occurs only in the outermost surface layer portion, the treating target X, such as a metal component, which is assumed in the present application, is not affected. Hence, the resistance of the treating target X does not decrease due to the coloring occurring in the present disclosure.

Additionally, it was found that, if the cooling rate of the treating target X is quick, occurrence of the grain boundary oxidation is further suppressed. It is considered that this is because oxidization of the treating target X starts at the beginning of cooling and the oxidization proceeds deeper in a portion that is hard to cool. In contrast, in the multi-chamber type heat treatment apparatus of the present embodiment, the blower 13 is started before the cooling gas Y is supplied to the cooling chamber 10. Accordingly, when the cooling gas Y is supplied to the circulation chamber 11, the turbofan 13*b* of the blower 13 is first rotationally driven, the cooling gas Y is supplied to the circulation chamber 11 and simultaneously the flow of the cooling gas Y is formed in the gas circulation path R, and the cooling rate of the treating target X is improved. Hence, according to the multi-chamber type heat treatment apparatus of the present embodiment, it is possible to more reliably suppress the grain boundary oxidation of the treating target X. Additionally, in a case where air is used as the cooling gas Y and in a case where the gas pressure of the air is made higher than the atmospheric pressure, the cooling gas Y can be supplied to the circulation chamber 11 in a shorter time than the time when the pressure of the air that is the cooling gas Y is the atmospheric pressure, and thus the cooling rate of the treating target X can be improved, and it is possible to more reliably suppress the grain boundary oxidation of the treating target X.

Although the preferred embodiment of the present disclosure has been described above referring to the attached drawings, the present disclosure is not limited to the above embodiment. In addition, various shapes, combinations, and the like of the respective constituent members that are shown in the above-described embodiment are examples, and can be variously changed on the basis of design requirements or the like without departing from the spirit of this disclosure.

Figure 5:
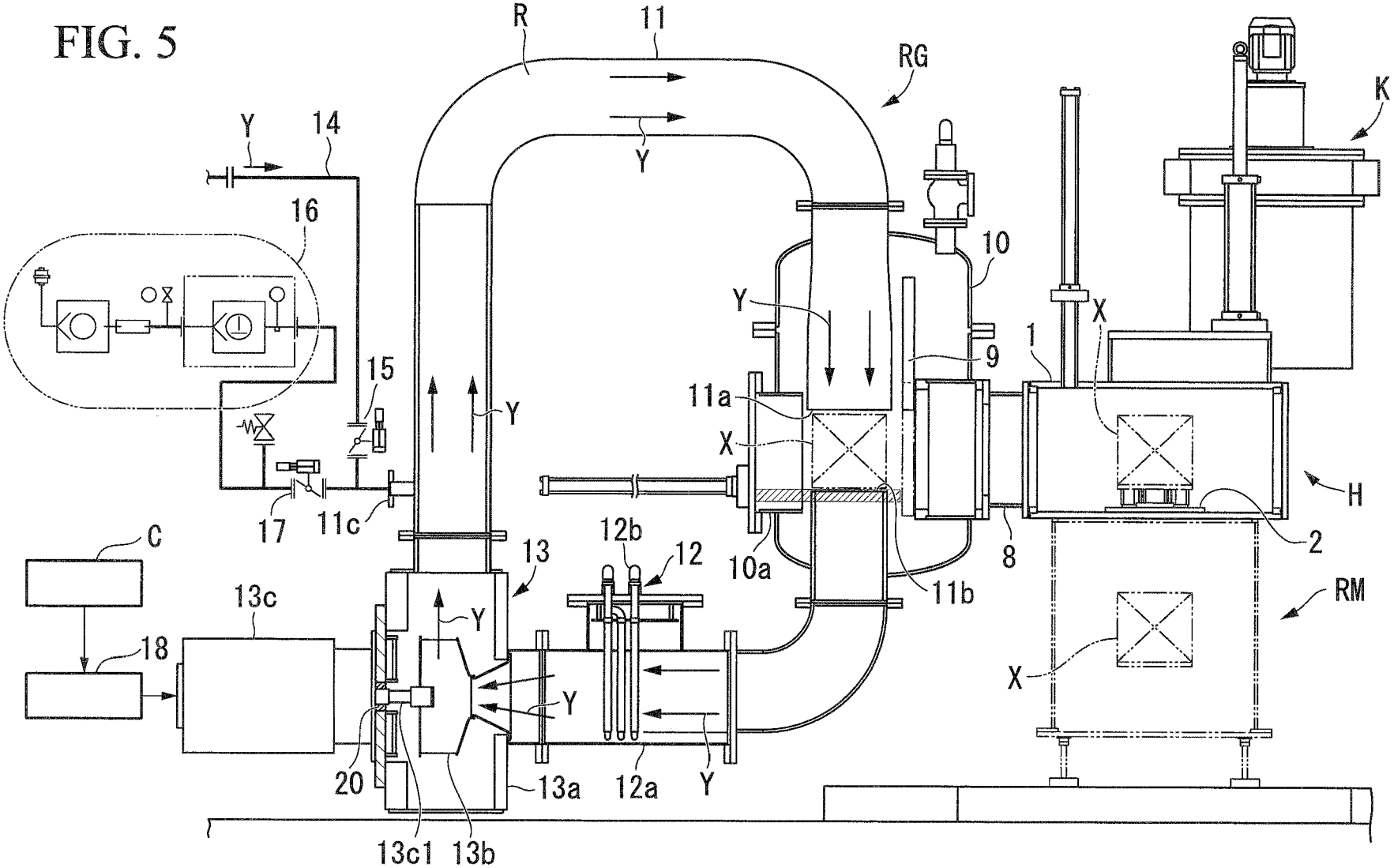
FIG. 5 is a longitudinal sectional view of a modification example of the multi-chamber type heat treatment apparatus related to the embodiment of the present disclosure as seen from the front.

For example, as shown in FIG. 5, the blower 13 may include a sealing part 20 disposed in a gap between the motor shaft 13*c*1 and the fan casing 13*a*. As this sealing part 20, for example, a non-contact labyrinth seal can be used. By including such a sealing part 20, it is possible to suppress evacuation of the inside of the water-cooled motor 13*c*, and it is possible to suppress occurrence of electrical discharge occurs even if the blower 13 is started before the cooling gas Y is supplied to the cooling chamber 10.

Figure 6:
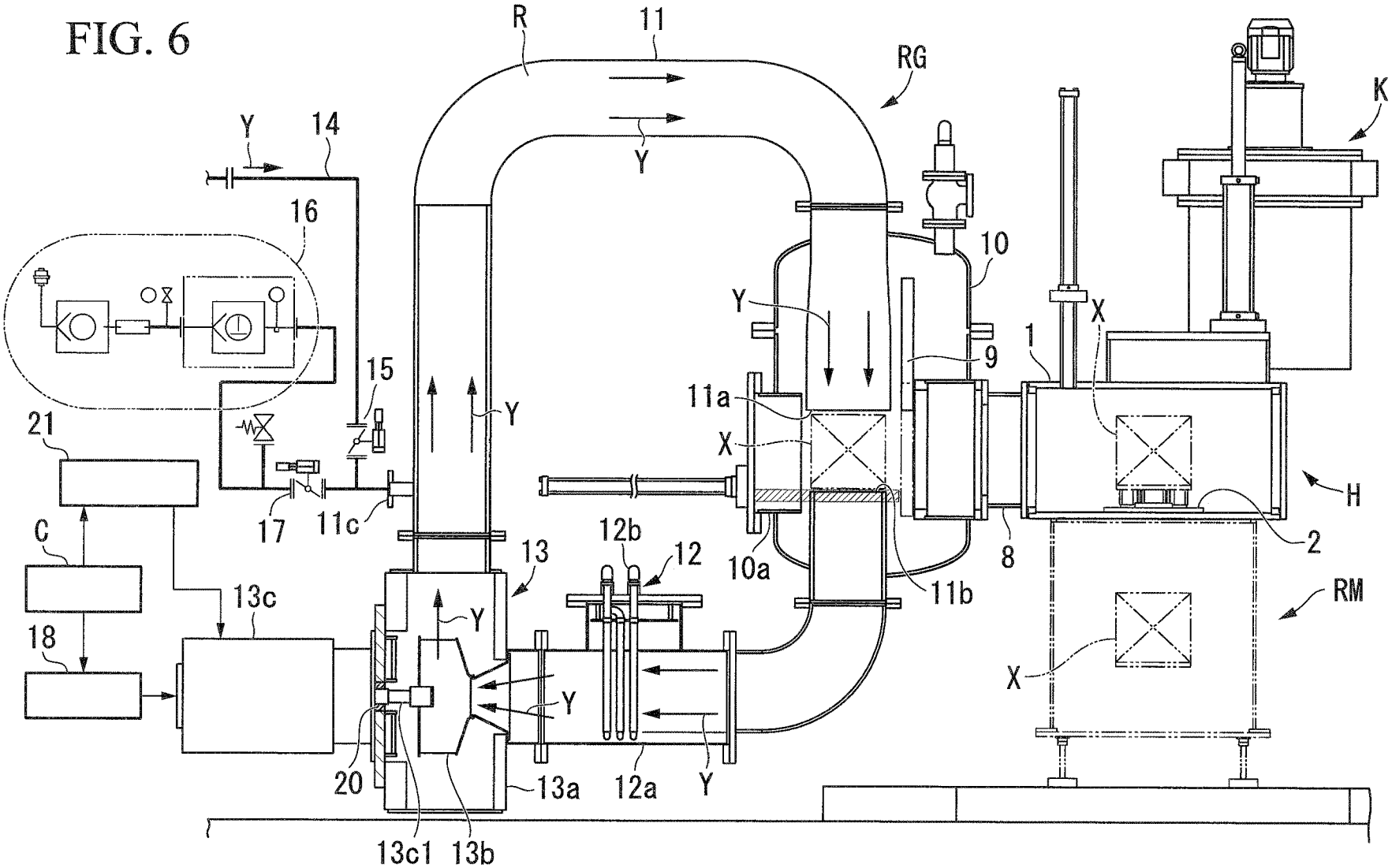
FIG. 6 is a longitudinal sectional view of the modification example of the multi-chamber type heat treatment apparatus related to the embodiment of the present disclosure as seen from the front.

Moreover, as shown in FIG. 6, a cooling gas supply part 21 that supplies the cooling gas under the control of the control device C may be included in the water-cooled motor 13*c*. Air can be supplied in advance to the water-cooled motor 13*c* by such a cooling gas supply part 21 before the air serving as cooling gas Y is supplied to the cooling chamber 10, and it is possible to suppress occurrence of that electrical discharge more reliably.

Additionally, although the gas circulation path R is provided in the above embodiment, the present disclosure is not limited to this. The gas circulation path R may be removed and the cooling gas used for the cooling of the treating target X may be discarded.

Moreover, although the three heating devices K (heating chambers) are provided in the above embodiment, the present disclosure is not limited to this. The number of heating devices K (heating chambers) may be one, two, or four or more.

Additionally, an example in which the present disclosure is applied in the multi-chamber type heat treatment apparatus including the intermediate conveying device H (extended chamber 8) has been described in the above embodiment. However, the present disclosure is not limited to this and can be applied to a heat treatment apparatus not including the intermediate conveying device H. For example, it is also possible to apply the present disclosure to a heat treatment apparatus with only two chambers of the heating chamber and the gas cooling chamber, and to use the cooling gas containing an oxidizer as a cooling gas to be used in the gas cooling chamber.

INDUSTRIAL APPLICABILITY

According to the heat treatment apparatus of the present disclosure, the treating target can be cooled using the cooling gas containing an oxidizer, and it is possible to enhance the degree of freedom of selection of the cooling gas while realizing desired heat treatment on the treating target.

What is claimed is:

1. A heat treatment apparatus configured such that a treating target is conveyed via an intermediate conveyance chamber and accommodated in a heating chamber, the heat treatment apparatus comprising:

a gas cooling chamber that is disposed adjacent to the intermediate conveyance chamber and in which the treating target is cooled using a cooling gas containing an oxidizer;

a circulation chamber having a first end and a second end, the first end forming a gas blow-in port extending toward the treating target within the gas cooling chamber, the second end forming a gas exhaust port extending toward the treating target so as to face the gas blow-in port with the treating target interposed therebetween;

an exhaust device that evacuates the gas cooling chamber through the circulation chamber;

cooling gas supply means configured to supply the cooling gas to the gas cooling chamber through the circulation chamber;

a blower that is provided at an intermediate portion of the circulation chamber and causes the cooling gas to flow; and a control device that causes the exhaust device to evacuate the gas cooling chamber before the cooling gas is supplied to the gas cooling chamber, starts the blower before the cooling gas is supplied to the gas cooling chamber, and causes the cooling gas supply means to supply the cooling gas to the gas cooling chamber after the blower is started.

2. A heat treatment apparatus comprising:

a heating chamber;

a gas cooling chamber in which a treating target is cooled using a cooling gas containing an oxidizer;

a circulation chamber having a first end and a second end, the first end forming a gas blow-in port extending toward the treating target within the gas cooling chamber, the second end forming a gas exhaust port extending toward the treating target so as to face the gas blow-in port with the treating target interposed therebetween;

an exhaust device that evacuates the gas cooling chamber through the circulation chamber;

cooling gas supply means configured to supply the cooling gas to the gas cooling chamber;

a blower that is provided at an intermediate portion of the circulation chamber and causes the cooling gas to flow; and a control device that causes the exhaust device to evacuate the gas cooling chamber before the cooling gas is supplied to the gas cooling chamber, starts the blower before the cooling gas is supplied to the gas cooling chamber, and causes the cooling gas supply means to supply the cooling gas to the gas cooling chamber after the blower is started.

3. The heat treatment apparatus according to claim 1, wherein the control device performs control such that a driving voltage of the blower at the start of supply of the cooling gas to the gas cooling chamber by the cooling gas supply means becomes lower than a driving voltage of the blower at the completion of supply of the cooling gas by the cooling gas supply means.

4. The heat treatment apparatus according to claim 2, wherein the control device performs control such that a driving voltage of the blower at the start of supply of the cooling gas to the gas cooling chamber by the cooling gas supply means becomes lower than a driving voltage of the blower at the completion of supply of the cooling gas by the cooling gas supply means.

5. The heat treatment apparatus according to claim 1, wherein the blower includes a fan that is rotationally driven, a motor having a motor shaft connected to the fan, and a sealing part that seals a periphery of the motor shaft.

6. The heat treatment apparatus according to claim 3, wherein the blower includes a fan that is rotationally driven, a motor having a motor shaft connected to the fan, and a sealing part that seals a periphery of the motor shaft.

7. The heat treatment apparatus according to claim 3, wherein the blower includes a fan that is rotationally driven, a motor having a motor shaft connected to the fan, and a sealing part that seals a periphery of the motor shaft.

8. The heat treatment apparatus according to claim 4, wherein the blower includes a fan that is rotationally driven, a motor having a motor shaft connected to the fan, and a sealing part that seals a periphery of the motor shaft.

9. The heat treatment apparatus according to claim 1, wherein the control device causes the cooling gas supply means to supply the cooling gas to the gas cooling chamber in a state where a gas pressure of the cooling gas is set to be higher than the atmospheric pressure.

10. The heat treatment apparatus according to claim 2, wherein the control device causes the cooling gas supply means to supply the cooling gas to the gas cooling chamber in a state where a gas pressure of the cooling gas is set to be higher than the atmospheric pressure.

11. The heat treatment apparatus according to claim 1, wherein the cooling gas supply means is connected to a tank in which air as the cooling gas is stored.

12. The heat treatment apparatus according to claim 2, wherein the cooling gas supply means is connected to a tank in which air as the cooling gas is stored.

* * * * *